US010180058B2

(12) United States Patent
Carter

(10) Patent No.: US 10,180,058 B2
(45) Date of Patent: Jan. 15, 2019

(54) TELEMETRY MODULE WITH PUSH ONLY GATE VALVE ACTION

(71) Applicant: Halliburton Energy Services, Inc., Houston, TX (US)

(72) Inventor: Daniel Patrick Carter, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 221 days.

(21) Appl. No.: 14/777,604

(22) PCT Filed: Dec. 4, 2014

(86) PCT No.: PCT/US2014/068500

§ 371 (c)(1),
(2) Date: Sep. 16, 2015

(87) PCT Pub. No.: WO2016/089402

PCT Pub. Date: Jun. 9, 2016

(65) Prior Publication Data

US 2016/0356153 A1 Dec. 8, 2016

(51) Int. Cl.
*E21B 47/18* (2012.01)
*F15B 13/044* (2006.01)
(Continued)

(52) U.S. Cl.
CPC ..... *E21B 47/185* (2013.01); *E21B 17/00* (2013.01); *E21B 17/16* (2013.01); *E21B 43/08* (2013.01); *E21B 47/18* (2013.01)

(58) Field of Classification Search
None
See application file for complete search history.

(56) References Cited

U.S. PATENT DOCUMENTS 4,686,658 A * 8/1987 Davison ..... E21B 47/185 137/487.5
4,842,020 A * 6/1989 Tinholt ..... F15B 13/0405 137/625.26

(Continued)

FOREIGN PATENT DOCUMENTS

WO 2014013256 A1 1/2014

OTHER PUBLICATIONS

International Search Report and Written Opinion for PCT/US2014/068500 dated Jul. 31, 2015.

*Primary Examiner* — Muhammad N Edun
*Assistant Examiner* — Jerold Murphy
(74) *Attorney, Agent, or Firm* — Alan Bryson; Tumey L.L.P

(57) ABSTRACT

An telemetry module includes a valve assembly having a gate defining gate valve flow ports and a valve seat defining valve seat flow ports. A first solenoid assembly is arranged on a first side of the valve assembly and includes a first valve train engageable with the gate and a first push solenoid operatively coupled to the first valve train to move the gate in a first direction. A second solenoid assembly is arranged on a second side of the valve assembly and includes a second valve train engageable with the gate and a second push solenoid operatively coupled to the second valve train to move the gate in a second direction opposite the first direction. Moving the gate in the first direction with the first solenoid increases flow through the gate and alternately moving the gate in the second direction with the second solenoid decreases flow through the gate.

23 Claims, 4 Drawing Sheets

(51) Int. Cl.

| | |
|---|---|
| ***F15B 13/04*** | (2006.01) |
| ***E21B 17/00*** | (2006.01) |
| ***E21B 17/16*** | (2006.01) |
| ***E21B 43/08*** | (2006.01) |

(56) References Cited

U.S. PATENT DOCUMENTS

| | | | | |
|---|---|---|---|---|
| 5,785,299 | A * | 7/1998 | Katsuta | F16K 31/0627 137/271 |
| 6,002,643 | A | 12/1999 | Tchakarov et al. | |
| 2002/0008634 | A1 | 1/2002 | Innes | |
| 2007/0258327 | A1 * | 11/2007 | Harvey | E21B 47/187 367/85 |
| 2012/0067591 | A1 * | 3/2012 | Couturier | E21B 21/106 166/373 |
| 2012/0067593 | A1 | 3/2012 | Powell et al. | |

* cited by examiner

TELEMETRY MODULE WITH PUSH ONLY GATE VALVE ACTION

BACKGROUND

Hydrocarbon drilling and production operations demand a great quantity of information relating to parameters and conditions downhole. Such information may include characteristics of the earth formations traversed by the borehole, along with data relating to the size and configuration of the borehole itself. The collection of information relating to conditions downhole is commonly termed "logging."

Drillers often simultaneously log a borehole while drilling, and thereby eliminate the need of removing or "tripping" the drilling assembly to insert a wireline logging tool to collect the required data. Data collection during drilling also enables the driller to make accurate modifications or corrections as needed to steer the well or optimize drilling performance while minimizing down time. Designs for measuring conditions downhole including the movement and location of the drilling assembly contemporaneously with the drilling of the well have come to be known as "measurement-while-drilling" techniques, or "MWD." Similar techniques that concentrate more on the measurement of formation parameters are commonly referred to as "logging-while-drilling" techniques, or "LWD." While distinctions between MWD and LWD may exist, the terms MWD and LWD are often used interchangeably.

In MWD and LWD tools, sensors in the drill string measure the desired drilling parameters and formation characteristics and continuously or intermittently transmit the information obtained to a surface detector by some form of telemetry. Most MWD and LWD tools use the drilling fluid (or mud) circulating through the drill string as the information carrier, and are thus referred to as mud pulse telemetry systems. In positive-pulse systems, a valve or other form of flow restrictor creates pressure pulses in the fluid flow by adjusting the size of a constriction inside the drill string. In negative-pulse systems, a valve creates pressure pulses by releasing fluid from the interior of the drill string into the annulus surrounding the drill string. In both system types, the pressure pulses propagate at the speed of sound through the drilling fluid to the surface, where they are detected by various types of surface transducers.

Drilling operations have become more complicated and customers are requiring more downhole sensors. This means that more data is required to be transmitted uphole in the same period of time, and thus higher data rates are now needed. At the same time, wells are getting deeper and directional wells are getting longer, which leads to the MWD and LWD tools being required to operate reliably for longer periods of time. Increasing the usable life of the MWD and LWD tools is a useful aspect in providing a competitive advantage in the marketplace.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools and, more particularly, to valve assemblies for mud pulse telemetry modules.

Embodiments of the present disclosure provide telemetry modules that substantially mitigate or eliminate abrasion or erosion between moving parts. This may be accomplished by substituting a T-slot joint commonly used in conventional telemetry modules to couple a gate to a valve stem with opposing valve stems positioned on either side of the gate. Corresponding push solenoids cooperatively push the opposing valve stems in opposite directions and thereby are able to repeatedly move the gate between open and closed positions. The opposing valve stems need not be coupled to the gate, but may instead be engageable therewith as pushed by its corresponding push solenoid. As a result, any impact that does occur during engagement between the gate and the opposing valve stems may result in substantially less stress and abrasion as compared to prior telemetry modules, and thus the parts may exhibit a longer fatigue life.

Figure 1:
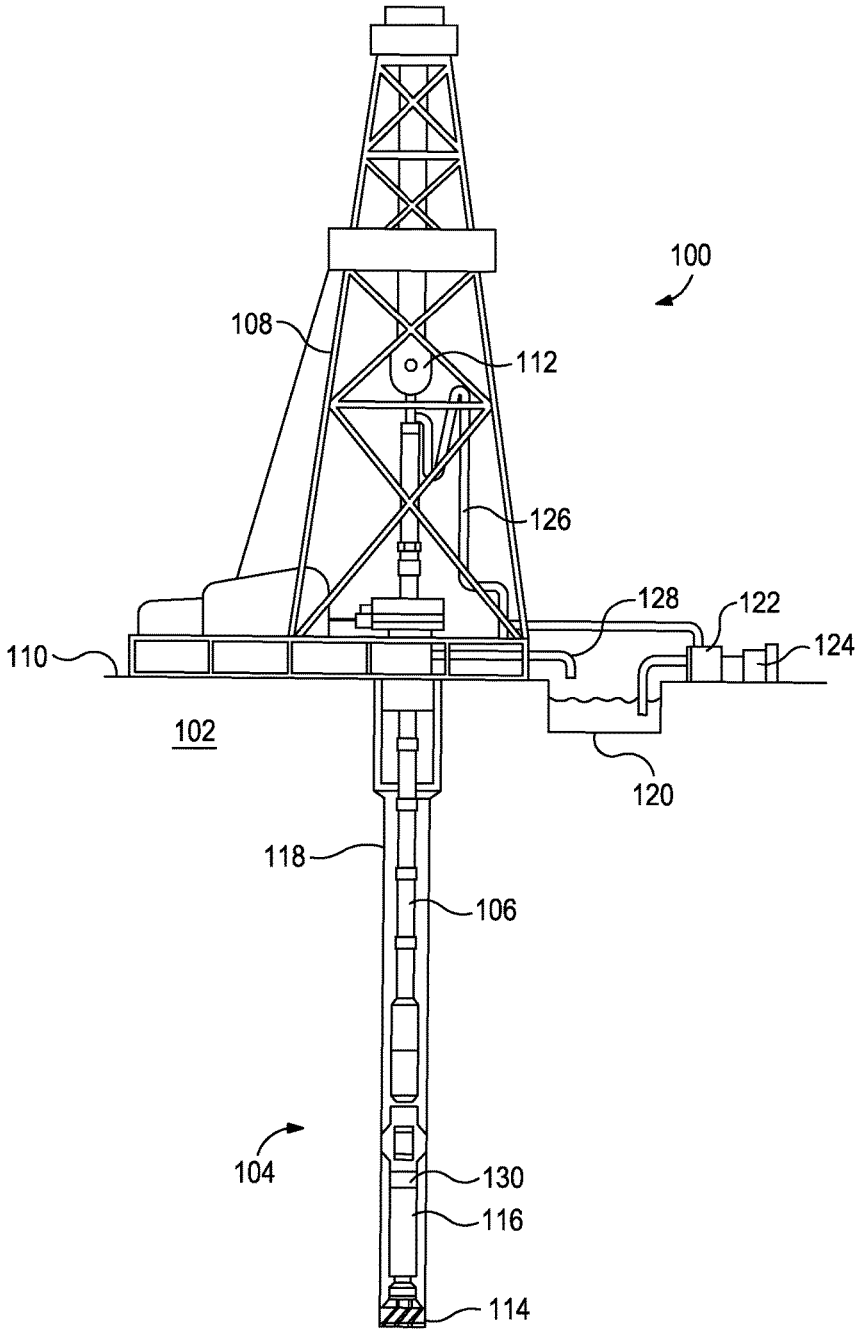
FIG. 1 is drilling system that can employ the principles of the present disclosure.

Referring to FIG. 1, illustrated is an exemplary drilling system 100 that may employ one or more principles of the present disclosure. Boreholes may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick 108 arranged at the surface 110. The derrick 108 includes a kelly 112 used to lower and raise the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, which may be configured to obtain downhole measurements of drilling conditions. In other embodiments, the measurement tools may be self-contained within the tool string 116, as shown in FIG. 1.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process returns drill cuttings and debris to the surface 110. The cuttings and mud mixture are passed through a flow line 128 and are processed such that a cleaned mud is returned down hole through the stand pipe 126 once again.

The tool string 116 may include a telemetry module 130 that may be operatively coupled to the MWD and/or LWD tools of the tool string 116. The telemetry module 130 may be configured to communicate with the MWD and/or LWD tools and transmit any measured data to the surface 110. To accomplish this, the telemetry module 130 may be configured to modulate a resistance to the flow of drilling fluid and thereby generate pressure pulses that propagate at the speed of sound to the surface. Various transducers located at the surface 110 may be configured to convert the pressure signals into electrical signals readable by a signal digitizer (not shown), such as an analog to digital converter. The signal digitizer supplies a digital form of the pressure signals to a computer (not shown) or some other form of a data processing device, and the computer operates in accordance with software (which may be stored on a computer-readable storage medium) to process and decode the received signals. The resulting telemetry data may be further analyzed and processed by the computer to generate a display of useful information. For example, a driller could employ the computer to obtain and monitor the position of the BHA 104, orientation information, drilling parameters, and formation properties.

Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Figure 2:
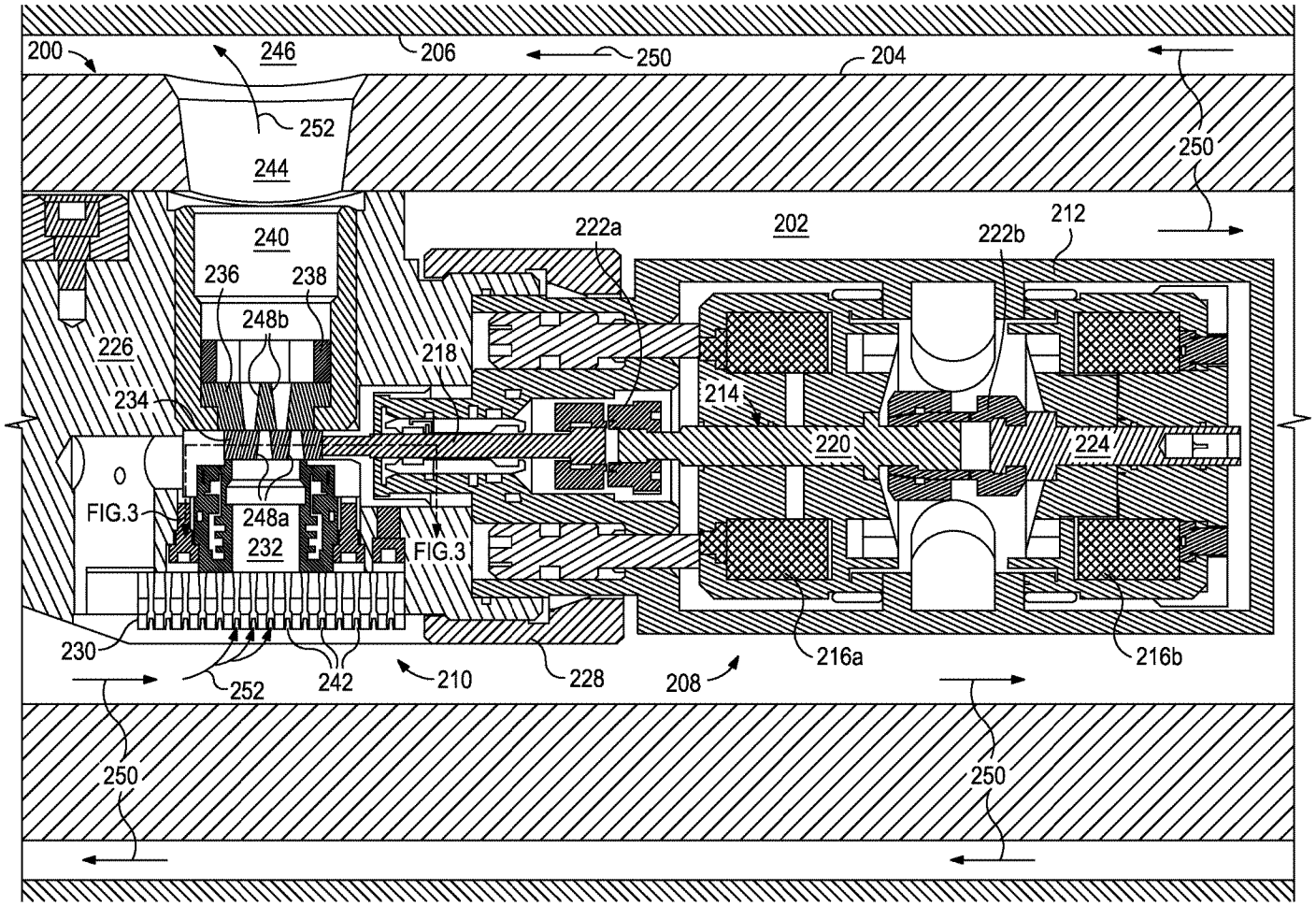
FIG. 2 is a cross-sectional side view of a telemetry module that may be used to communicate with a surface location.

Referring now to FIG. 2, illustrated is a cross-sectional side view of a telemetry module 200 that may be used to communicate with a surface location. The telemetry module 200 may be similar in some respects to the telemetry module 130 of FIG. 1 and, therefore, may be able to communicate with the surface 110 (FIG. 1). As illustrated, the telemetry module 200 may be positioned within an interior 202 of a tubular member 204 arranged within a wellbore 206. In some embodiments, the tubular member 204 may form part of the drill string 106 (FIG. 1), such as forming part of the tool string 116 (FIG. 1) and otherwise extendable into the wellbore 206 from the surface 110. Accordingly, the tubular member 204 may be drill pipe or a drill collar included in a string of drill pipe. In other embodiments, however, the tubular member 204 may be any other pipe or tubing used in the oil and gas industry such as casing or production tubing, without departing from the scope of the disclosure.

As illustrated, the telemetry module 200 may generally include a solenoid assembly 208 and a valve assembly 210. As illustrated, the solenoid assembly 208 may include a casing 212 that houses a valve train 214, a first or push solenoid 216*a*, and a second or pull solenoid 216*b*. The valve train 214 may include a valve stem 218, a push rod 220, and a pull rod 224. The push rod 220 may be operatively coupled to the valve stem 218 at a first coupling 222*a*, and the pull rod 224 may be operatively coupled to the push rod 220 at a second coupling 222*b*. The first and second couplings 222*a,b* operate to couple each of the valve stem 218, the push rod 220, and the pull rod 224 such that the valve train 214 is able to move as a single or unitary component of the solenoid assembly 208.

The push solenoid 216*a* may be operatively coupled to and otherwise configured to act on the push rod 220 to urge the push rod 220 toward the valve assembly 210 (i.e., in an uphole direction) when activated. Conversely, the pull solenoid 216*b* may be operatively coupled to and otherwise configured to act on the pull rod 222 such that it is pulled or urged away from the valve assembly 210 (i.e., in a downhole direction) when activated. Accordingly, alternating operation of the push and pull solenoids 216*a,b* may be configured to axially translate the entire valve train 214 toward and away from the valve assembly 210.

The valve assembly 210 and its various component parts may be housed within a valve housing 226. The valve housing 226 may be operatively coupled to the casing 212 using, for example, a threaded collar 228 or the like. As illustrated, the valve assembly 210 may generally include a screen 230, an inlet port 232, a gate 234, a valve seat 236, a lock nut 238, and an outlet port 240. The screen 230 may provide or otherwise define a plurality of slots 242 that allow fluid within the interior 202 of the tubular member 204 to pass through the screen 230 and into the inlet port 232 while simultaneously filtering out particulate matter of a predetermined size and greater.

The gate 234 may be generally arranged within and otherwise in fluid communication with the inlet port 232. As described in more detail below, the gate 234 may be operatively coupled to the valve stem 218. The valve stem 218 extends out of the casing 212 and partially into the valve housing 226 to be operatively coupled to the gate 234 such that axial translation or movement of the valve stem 218 correspondingly moves the gate 234 axially within the valve housing 226.

The valve seat 236 may be secured within the valve housing 226 with the lock nut 238 and may be in fluid communication with the outlet port 240. The outlet port 240 may be aligned with and otherwise in fluid communication with an annulus port 244 defined through the tubular member 204. The annulus port 244 may place the outlet port 240 in fluid communication with an annulus 246 defined between the tubular member 204 and the wall of the wellbore 206.

Each of the gate 234 and the valve seat 236 may provide and otherwise define one or more flow ports 248, shown as flow ports 248*a* defined in the gate 234 and flow ports 248*b* defined in the valve seat 236. When the flow ports 248*a* of the gate 234 are at least partially axially aligned with the flow ports 248*b* of the valve seat 236, fluids may be able to communicate through the gate 234 and the valve seat 236 and otherwise between the inlet and outlet ports 232, 240. Conversely, however, when the flow ports 248*a,b* are axially misaligned, a metal-to-metal seal is generated across the interface between the gate 234 and the valve seat 236 such that fluids are prevented from communicating between the inlet and outlet ports 232, 240. As operatively coupled to the valve stem 218, and, therefore, the valve train 214, the gate 234 may be moved between an open position, where the flow ports 248*a,b* are axially aligned, and a closed position, where the flow ports 248*a,b* are axially misaligned.

Exemplary operation of the telemetry module 200 is now provided. A fluid 250 may be introduced into the interior 202 of the tubular member 204, such as from a surface location (e.g., the surface 110 of FIG. 1). The fluid 250 may be a drilling fluid or "mud" that is conveyed to and circulated past the telemetry module 200 within the interior 202 until reaching a drill bit (e.g., the drill bit 114 of FIG. 1). The fluid 250 may exit the drill bit via one or more nozzles arranged in the drill bit and circulate back to the surface location via the annulus 246. The pressure of the fluid 250 in the interior 202 may be greater than the pressure of the fluid in the annulus 246. As a result, a pressure differential may be generated across the telemetry module 200 and, more particularly, the valve assembly 210.

Until prompted, the telemetry module 200 may remain inactive with the gate 234 maintained in the closed position, as shown in FIG. 2. The telemetry module 200 may be in communication with one or more sensors, such as the MWD and/or LWD tools of the tool string 116 (FIG. 1). When it is desired to communicate sensor measurement information to a surface location (e.g., the surface 110 of FIG. 1), a command signal may be sent to the push and pull solenoids 216*a,b* to cooperatively translate the valve train 214 within the casing 212 and thereby selectively move the gate 234 axially between the open and closed positions. When the gate 234 moves to the open position and the flow ports 248*a,b* are thereby aligned, a portion 252 of the fluid 250 may be able flow through the valve assembly 210 seeking pressure equilibrium. More particularly, the portion 252 may be able to pass through the screen 230 and traverse the gate 234 and the valve seat 236 via the fluidly communicating inlet and outlet ports 232, 240 and thereafter be introduced into the annulus 246 via the annulus port 244. Injecting the portion 252 of the fluid 250 into the annulus 246 may generate a pressure pulse that may propagate to the surface location via the annulus 246. At the surface location, the generated pressure pulse may be detected and decoded, as generally described above.

Figure 3:
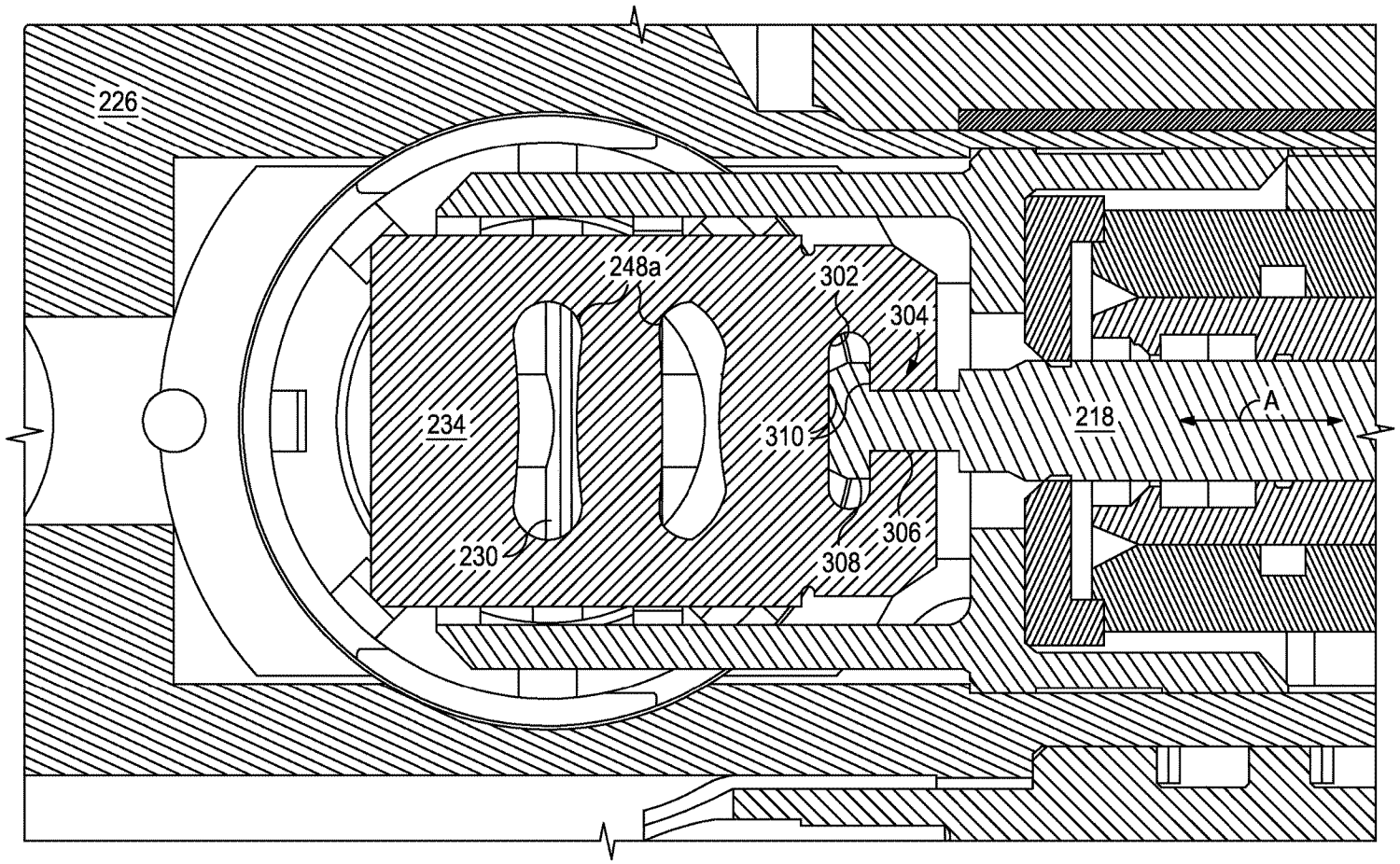
FIG. 3 is an enlarged cross-sectional top view of the gate of FIG. 2 as taken along the lines shown in FIG. 2.

Referring now to FIG. 3, with continued reference to FIG. 2, illustrated is an enlarged cross-sectional top view of the gate 234 as taken along the lines (FIG. 3-FIG. 3) shown in FIG. 2. The flow ports 248*a* defined through the gate 234 are depicted in FIG. 3, and portions of the screen 230 may be seen below through the flow ports 248*a*. Moreover, the valve stem 218 is depicted as being operatively coupled to the gate 234 at a T-slot joint 302 formed in the gate 234. More particularly, the valve stem 318 may have an end 304 that provides a neck 306 and a head 308 that extends axially from the neck 306. The neck 306 may exhibit a diameter that is smaller than the diameter of the head 308 and, therefore, the head 308 may be configured to be received within the T-slot joint 302 and engage the inner surfaces 310 of the T-slot joint 302 to effectively couple the valve stem 218 to the gate 234. As operatively coupled to the gate 234 at the T-slot joint 302, axial movement of the valve stem 218 back and forth in the direction A as acted upon by the push and pull solenoids 216*a,b* (FIG. 2) will correspondingly move the gate 234 in the direction A.

The gate 234 and the valve stem 218 may each be made of a hardened material. For instance, in some embodiments, the gate 234 and, therefore, the T-slot joint 302, may be made of tungsten carbide, and the valve stem 318 may be made of stainless steel. During operation, moving the gate 234 back and forth in the axial direction A in the presence of abrasive fluids (e.g., the fluid 250 and the portion 252 of the fluid 250 of FIG. 2) may cause wear and erosion to occur on the gate 234 and, more particularly, on the T-slot joint 302 at the inner surfaces 310. As the push and pull solenoids 216*a,b* cooperatively push and pull the valve train 214 (FIG. 2) in the direction A to repeatedly open and close the gate 234, abrasion caused by the relative movement between the gate 234 and the valve stem 218 in a drilling fluid environment may wear the head 308 of the valve stem 218 to the point where movement of the gate 234 becomes severely limited. Over time, such wear and erosion at the inner surfaces 310 may render the connection between the T-slot joint 302 and the valve stem 218 essentially ineffectual.

According to embodiments of the present disclosure, the adverse effects of wear and erosion on the T-slot joint 302 at the inner surfaces 310 between the gate 234 and the valve stem 218 may be resolved by entirely omitting the T-slot joint 302 from a telemetry module. As described below, embodiments of an exemplary telemetry module may include solenoids positioned on either side of the gate 234. In such embodiments, the solenoids may cooperatively push the gate 234 back and forth in the axial direction A, without the gate 234 being pulled by the valve stem 218. As will be appreciated, with the gate 234 is no longer being pulled by the valve stem 218 for movement in the axial direction A, the T-slot joint 302 may no longer be required.

Figure 4:
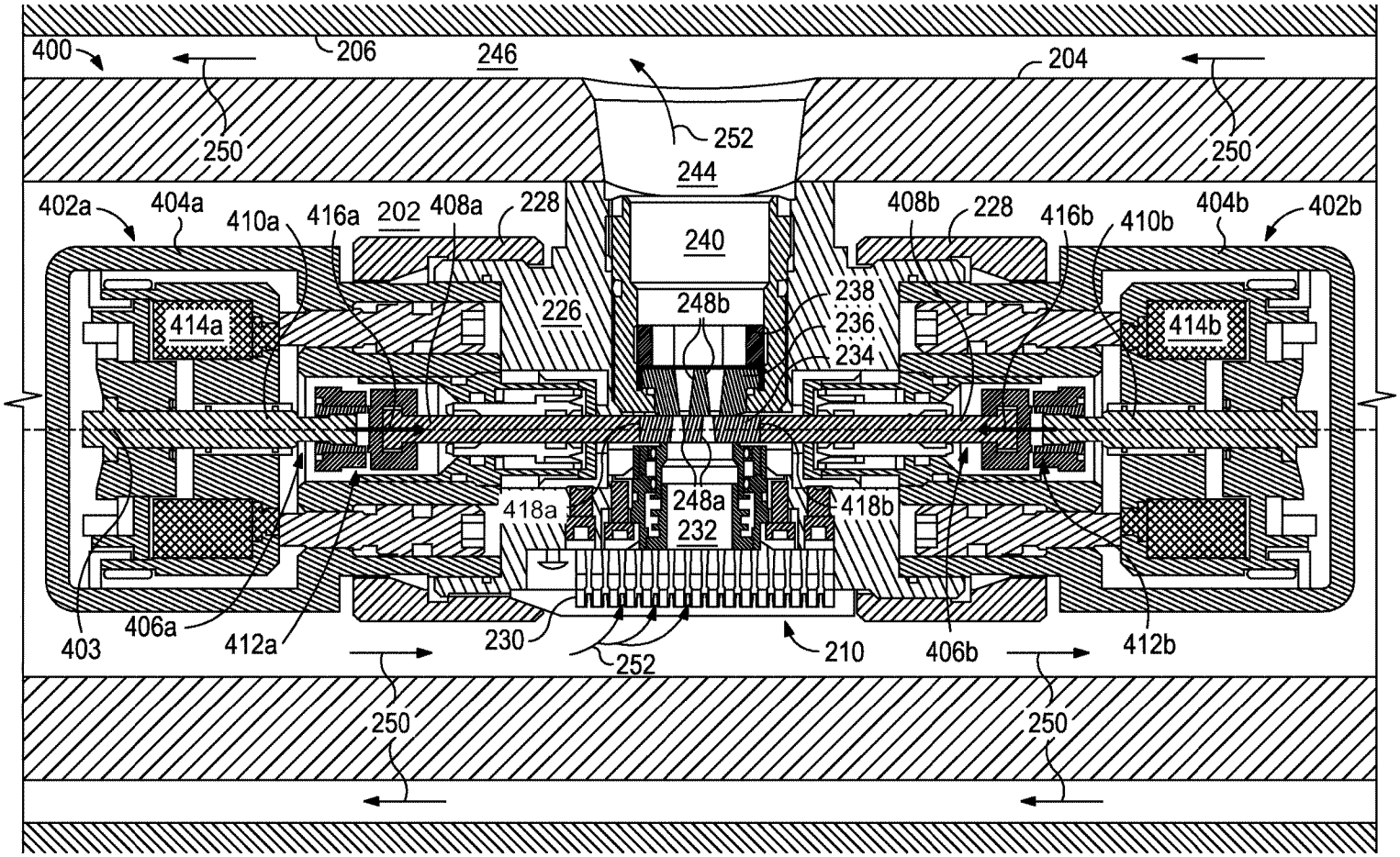
FIG. 4 is a cross-sectional side view of an exemplary telemetry module that employs the principles of the present disclosure.

Referring now to FIG. 4, illustrated is a cross-sectional side view of an exemplary telemetry module 400 that may employ the principles of the present disclosure, according to one or more embodiments. The telemetry module 400 may be similar in some respects to the telemetry module 200 of FIG. 2 and therefore may be best understood with reference thereto, where like numerals refer to like components or elements not described again in detail. For instance, similar to the telemetry module 200 of FIG. 2, the telemetry module 400 may be positioned within the interior 202 of the tubular member 204, which may be extended into and otherwise arranged within the wellbore 206. The annulus port 244 may be defined in the tubular member 204 to provide fluid communication to the annulus 246. Moreover, the telemetry module 400 may further include the valve assembly 210, which may include the valve housing 226, the screen 230, the inlet port 232, the gate 234, the valve seat 236, and the outlet port 240.

Unlike the telemetry module 200 of FIG. 2, however, the telemetry module 400 may include a first or upper solenoid assembly 402*a* and a second or lower solenoid assembly 402*b*. As illustrated, the upper and lower solenoid assemblies 402*a,b* may be generally aligned with a longitudinal axis 402 of the tubular member 204. More particularly, the upper solenoid assembly 402*a* may be positioned on a first or uphole side of the valve assembly 210, and the lower solenoid assembly 402*b* may be positioned on a second or downhole side of the valve assembly 210. It should be noted that, although the upper and lower solenoid assemblies 402*a,b* are depicted as being generally arranged along the longitudinal axis 403 of the tubular member 204 (i.e., uphole and downhole from the valve assembly 210), embodiments are contemplated herein where the upper and lower solenoid assemblies 402*a,b* are arranged orthogonal to the longitudinal axis 403 and otherwise arranged at generally the same axial position along the tubular member 204. Accordingly, having the upper and lower solenoid assemblies 402*a,b* positioned on opposing sides of the valve assembly 210 may refer to axially aligning the upper and lower solenoid assemblies 402*a,b* along the longitudinal axis 403 of the tubular member 204, but also aligning the upper and lower solenoid assemblies 402*a,b* orthogonal to the longitudinal axis 403 of the tubular member 204. Moreover, having the upper and lower solenoid assemblies 402*a,b* positioned on opposing sides of the valve assembly 210 may further refer to aligning the upper and lower solenoid assemblies 402*a,b* on either side of the valve assembly anywhere between the longitudinal axis 403 of the tubular member 204 and orthogonal thereto, without departing from the scope of the disclosure.

Each of the upper and lower solenoid assemblies 402*a,b* may be similar in some respects to the solenoid assembly 208 of FIG. 2. For instance, each of the upper and lower solenoid assemblies 402*a,b* may include a casing 404, shown as casings 404*a* and 404*b*, respectively that houses a valve train 406, shown as valve trains 406*a* and 406*b*, respectively. Each casing 404*a,b* may be operatively coupled the valve housing 226 on either side using, for example, a threaded collar 228 or the like. Each valve train 406*a,b* may further include a valve stem 408, shown as valve stems 408*a* and 408*b*, respectively, and a push rod 410, shown as push rods 410*a* and 410*b*, respectively. Each valve stem 408*a,b* may be operatively coupled its corresponding push rod 410*a,b*, respectively, at a coupling 412, shown as couplings 412*a* and 412*b*, respectively.

The couplings 412*a,b* may operate to couple the valve stems 408*a,b* to the push rods 410*a,b*, respectively, such that movement of the push rod 410*a,b* correspondingly moves the corresponding valve stem 408*a,b* during operation. In some embodiments, the first and second couplings 412*a,b* may be adjustable and thereby able to adjust a stroke length for each valve train 406*a,b*. This may prove advantageous in optimizing operation of each valve train 406*a,b* such that the flow ports 248*a,b* of the gate 234 and the valve seat 236, respectively, may align and misalign as desired for operation. It will be appreciated, however, that the couplings 412*a,b* may be omitted in at least one embodiment. In such embodiments, each valve stem 408*a,b* may be directly attached to or otherwise form an integral part of the corresponding push rods 410*a,b*, without departing from the scope of the disclosure.

The upper and lower solenoid assemblies 402*a,b* may each include a push solenoid 414, shown as a first or upper push solenoid 414*a* and a second or lower push solenoid 414*b*. The upper push solenoid 414*a* may be operatively coupled to and otherwise configured to act on the upper push rod 410*a* such that it is pushed or urged toward the valve assembly 210 in a first direction 416*a* when activated. Conversely, the lower push solenoid 414*b* may be operatively coupled to and otherwise configured to act on the lower push rod 410*b* such that it is pushed or urged toward the valve assembly 210 in a second direction 416*b*. As illustrated, the second direction 416*b* is opposite the first direction 416*a* and, therefore, the upper and lower push solenoids 414*a,b* may be configured to cooperatively operate to move the upper and lower push rods 410*a,b* in opposing directions. 202

The upper valve stem 408*a* may be configured to engage a first side surface 418*a* of the gate 234, and the lower valve stem 408*b* may be configured to engage a second side surface 418*b* of the gate 234, where the first side surface 418*a* is opposite the second side surface 418*b* on the gate 234. In some embodiments, one or both of the upper and lower valve stems 408*a,b* may be coupled to the gate 234 at the first and second side surfaces 418*a,b*, respectively, such as via a mechanical attachment (e.g., a weld, a brazed interface, a mechanical fastener, etc.). In other embodiments, however, the upper and lower valve stems 408*a,b* only engage or contact the first and second side surfaces 418*a,b*, respectively, of the gate 234 but no coupling engagement is involved. In such embodiments, the gate 234 may, therefore, float between the upper and lower valve stems 408*a,b*. Any clearance or "slop" between the upper and lower valve stems 408*a,b* and the first and second side surfaces 418*a,b*, respectively, may be eliminated by adjusting the couplings 412*a,b*.

Exemplary operation of the telemetry module 400 is now provided. The fluid 250 may be introduced into the interior 202 of the tubular member 204, such as from a surface location (e.g., the surface 110 of FIG. 1) and circulated past the telemetry module 400 until reaching a drill bit (e.g., the drill bit 114 of FIG. 1). The fluid 250 may then exit the drill bit via one or more nozzles arranged in the drill bit and circulate back to the surface location via the annulus 246. The pressure of the fluid 250 in the interior 202 may be greater than the pressure of the fluid in the annulus 246 and, as a result, a pressure differential may be generated across the telemetry module 400 and, more particularly, across the valve assembly 210.

Until prompted, the telemetry module 400 may remain inactive with the gate 234 maintained in the closed position, where the flow ports 248*a,b* are axially misaligned and a metal-to-metal seal is generated at the interface between the gate 234 and the valve seat 236. As will be appreciated, such a metal-to-metal seal may remain at least partially intact as the gate 234 is moved between the closed and open positions. The telemetry module 400 may be in communication with one or more sensors, such as the MWD and/or LWD tools of the tool string 116 (FIG. 1). When it is desired to communicate sensor measurement information to a surface location, a command signal may be sent to the upper and lower solenoid assemblies 402*a,b*, which cooperatively operate to move the gate 234 axially between the open and closed positions. More particularly, to move the gate 234 between the open and closed positions, the lower push solenoid 414*b* may remain inactive while the upper push solenoid 414*a* may be activated to push or urge the upper valve train 406*a* in the first direction 416*a*. Pushing the upper valve train 406*a* in the first direction 416*a* may engage the upper valve stem 408*a* on the gate 234 at the first side surface 418*a* and thereby correspondingly move the gate 234 in the first direction 416*a*. In some embodiments, while the lower push solenoid 414*b* remains inactive, the lower valve train 406*b* may freely move and, therefore, may also be moved in the first direction 416*a* as the gate 234 engages the lower valve stem 408*b* at the second side surface 418*b*.

The upper push solenoid 414*a* may be configured to push the gate 234 in the first direction 416*a* until the flow ports 248*a,b* in the gate 234 and the valve seat 236, respectively, become generally aligned. Once the flow ports 248*a,b* are aligned, a portion 252 of the fluid 250 may be able flow through the valve assembly 210 seeking pressure equilibrium and be introduced into the annulus 246 via the annulus port 244. More particularly, the portion 252 may be able to pass through the screen 230 and the inlet port 232 and thereafter traverse the gate 234 and the valve seat 236 via the aligned flow ports 248*a,b*. The portion 252 may then pass through the outlet port 240 and the annulus port 244 to be injected into the annulus 246. As discussed above, injecting the portion 252 of the fluid 250 into the annulus 246 may generate a pressure pulse in the annulus 246 that may propagate to the surface location within the annulus 246.

The lower push solenoid 414*b* may then be operated to move the gate 234 back to the closed position, where the valve ports 248*a,b* once again become misaligned. To accomplish this, the upper push solenoid 414*a* may be inactive while the lower push solenoid 414*b* is activated to push or urge the lower valve train 406*b* in the second direction 416*b*. Pushing the lower valve train 406*b* in the second direction 416*b* may engage the lower valve stem 408*b* on the gate 234 at the second side surface 418*b* and correspondingly move the gate 234 in the second direction 416*b*. While the upper push solenoid 414*a* is inactive, the upper valve train 406*a* may be able to freely move and, therefore, may also be moved in the second direction as the gate 234 engages the upper valve stem 408*a* at the first side surface 418*a*.

As will be appreciated, while the above description describes the upper push solenoid 414*a* as opening the gate 234 and the lower push solenoid 414*b* as closing the gate 234, an opposite configuration may equally be configured, without departing from the scope of the disclosure. For example, in other embodiments, operation of the lower push solenoid 414*b* may be configured to open the gate 234, while operation of the upper push solenoid 414*a* may be configured to close the gate 234. In either case, alternating operation or activation of the upper and lower push solenoids 414*a,b* may result in the gate 234 being repeatedly moved between the open and closed positions, and thereby selectively introducing pressure pulses into the annulus 246 that may propagate to the surface to be detected and decoded.

Drilling operations are becoming increasingly more complicated and well operators are requiring more downhole sensors. As a result, more data is required to be transmitted uphole in the same time period, and thus higher data rates are needed. At the same time, wells are getting deeper and directional wells are getting longer, which means that downhole tools, such as telemetry modules, may be required to operate downhole for longer periods of time. This means that telemetry modules must operate reliably for longer periods of time and at faster rates. As will be appreciated, the telemetry module 400 described herein may prove advantageous over the telemetry module 200 of FIG. 2 since there is no relative movement between the gate 234 and the upper and lower valve stems 408*a,b* in the telemetry module 400. As a result, material removal at the upper and lower valve stems 408*a,b* due to abrasion or erosion may be substantially mitigated, if not eliminated altogether. Moreover, since the telemetry module 400 does not include the high-stress features of the T-slot joint 302 (FIG. 3) of the telemetry module 200, any impact that does occur during engagement between the gate 234 and the upper and lower valve stems 408*a,b* may result in substantially less stress and thus the parts will have a longer fatigue life.

Embodiments disclosed herein include:

A telemetry module that includes a valve assembly positionable within an interior of a tubular member and including a gate defining one or more gate valve flow ports and a valve seat defining one or more valve seat flow ports, a first solenoid assembly arranged on a first side of the valve assembly and including a first valve train engageable with the gate and a first push solenoid operatively coupled to the first valve train to move the gate in a first direction, and a second solenoid assembly arranged on a second side of the valve assembly and including a second valve train engageable with the gate and a second push solenoid operatively coupled to the second valve train to move the gate in a second direction opposite the first direction, and wherein moving the gate in the first direction with the first solenoid increases flow through the gate and alternately moving the gate in the second direction with the second solenoid decreases flow through the gate.

B. A well system that includes a tubular member extendable within a wellbore, the tubular member defining an annulus port that provides fluid communication between an interior of the tubular member and an annulus defined between the tubular member and the wellbore, a telemetry module positioned within the tubular member and including a valve assembly that provides a gate defining one or more gate valve flow ports and a valve seat defining one or more valve seat flow ports, a first solenoid assembly arranged on a first side of the valve assembly and including a first push solenoid that operates to move the gate in a first direction, and a second solenoid assembly arranged on a second side of the valve assembly and including a second push solenoid that operates to move the gate in a second direction opposite the first direction, wherein moving the gate in the first direction with the first solenoid increases flow through the gate and alternately moving the gate in the second direction with the second solenoid decreases flow through the gate.

A method that includes introducing a telemetry module into a wellbore, the telemetry module being positioned within an interior of a tubular member and providing a valve assembly that includes a gate movable with respect to a valve seat, the telemetry module further including a first solenoid assembly arranged on a first side of the valve assembly and having a first push solenoid, and a second solenoid assembly arranged on a second side of the valve assembly and having a second push solenoid, wherein the first side is opposite the second side, circulating a fluid through the interior of the tubular member, the tubular member defining an annulus port that provides fluid communication between an annulus defined between the tubular member and the wellbore and the interior via the valve assembly, activating the first push solenoid to move the gate in a first direction and increase flow through the gate, thereby injecting a portion of the fluid into the annulus via the valve assembly and thereby generating a pressure pulse within the annulus, activating the second push solenoid to move the gate in a second direction opposite the first direction to decrease flow through the gate, and alternatingly activating the first and second push solenoids to selectively move the gate in the first and second directions and thereby injecting portions of the fluid into the annulus that generate a plurality of pressure pulses within the annulus.

Each of embodiments A, B, and C may have one or more of the following additional elements in any combination: Element 1: wherein the first and second solenoid assemblies are aligned with a longitudinal axis of the tubular member. Element 2: wherein the first and second solenoid assemblies are misaligned with a longitudinal axis of the tubular member. Element 3: wherein the first and second valve stems are operatively coupled to the first and second push rods, respectively, with corresponding first and second couplings. Element 4: wherein the first and second couplings are each adjustable to adjust a stroke length for the first and second push rods, respectively. Element 5: wherein, when the first push solenoid is operated to move the first push rod in the first direction, the second push solenoid is inactive and the second valve stem and the second push rod are able to move in the first direction, and wherein, when the second push solenoid is operated to move the second push rod in the second direction, the first push solenoid is inactive and the first valve stem and the first push rod are able to move in the second direction. Element 6: wherein the gate floats between the first and second valve stems. Element 7: wherein the gate is operatively coupled to one or both of the first and second valve stems.

Element 8: wherein the tubular member is selected from the group consisting of drill pipe, a drill collar, casing, production tubing, and any combination thereof. Element 9: wherein the valve assembly further comprises a screen in fluid communication with the interior of the tubular member, an inlet port in fluid communication with the interior via the screen, and an outlet port in fluid communication with the annulus port, wherein, when the gate is in the open position, a fluid in the interior is able to traverse the valve assembly and be introduced into the annulus. Element 10: wherein the first push solenoid is operatively coupled to a first push rod, which is operatively coupled to a first valve stem engageable with a first side surface of the gate, and the second push solenoid is operatively coupled to a second push rod, which is operatively coupled to a second valve stem engageable with a second side surface of the gate, the second side surface being opposite the first side surface. Element 11: wherein the first and second valve stems are operatively coupled to the first and second push rods, respectively, with corresponding first and second couplings. Element 12: wherein the first and second couplings are each adjustable to adjust a stroke length for the first and second push rods, respectively. Element 13: wherein, when the first push solenoid is operated to move the first push rod in the first direction, the second push solenoid is inactive and the second valve stem and the second push rod are able to move in the first direction, and wherein, when the second push solenoid is operated to move the second push rod in the second direction, the first push solenoid is inactive and the first valve stem and the first push rod are able to move in the second direction. Element 14: wherein the gate floats between the first and second valve stems.

Element 15: wherein the valve assembly further comprises, a screen in fluid communication with the interior of the tubular member, an inlet port in fluid communication with the interior via the screen, and an outlet port in fluid communication with the annulus port, and wherein injecting the portion of the fluid into the annulus via the valve assembly comprises flowing the portion of the fluid into the inlet port via the screen, flowing the portion of the fluid from the inlet port and into the outlet port via the one or more gate valve flow ports aligned with the one or more valve seat flow ports, and flowing the portion of the fluid from the outlet port into the annulus via the annulus port. Element 16: wherein the first push solenoid is operatively coupled to a first push rod, which is operatively coupled to a first valve stem engageable with a first side surface of the gate, and wherein activating the first push solenoid and thereby moving the gate in the first direction comprises pushing the first push rod and the first valve stem with the first push solenoid to engage the first side surface of the gate. Element 17: wherein the second push solenoid is operatively coupled to a second push rod, which is operatively coupled to a second valve stem engageable with a second side surface of the gate, the second side surface being opposite the first side surface, and wherein activating the second push solenoid to move the gate in the second direction comprises pushing the second push rod and the second valve stem with the second push solenoid to engage the second side surface of the gate. Element 18: further comprising deactivating the second push solenoid when the first push solenoid is activated, and deactivating the first push solenoid when the second push solenoid is activated. Element 19: wherein the first and second couplings are each adjustable to adjust a stroke length for the first and second push rods, respectively. Element 20: wherein the telemetry module is communicably coupled to one or more sensors, the method further comprising communicating measurements obtained by the one or more sensors by generating the plurality of pressure pulses within the annulus. Element 21: wherein the first valve train includes a first valve stem operatively coupled to a first push rod engageable with a first side surface of the gate, and wherein the second valve train includes a second valve stem operatively coupled to a second push rod engageable with a second side surface of the gate.

By way of non-limiting example, exemplary combinations applicable to A, B, and C include: Element 3 with Element 4; Element 10 with Element 11; Element 11 with Element 12; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A telemetry module, comprising:

a valve assembly positionable within an interior of a tubular member and including a gate defining one or more gate valve flow ports and a valve seat defining one or more valve seat flow ports;

a first solenoid assembly arranged on a first side of the valve assembly and including an adjustable first valve train engageable with the gate and a first push solenoid operatively coupled to the adjustable first valve train to move the gate in a first direction, wherein the adjustable first valve train includes a first valve stem operatively coupled to a first push rod with a first coupling, wherein the first valve stem is arranged laterally to the first push rod with a first distance between the first push rod and the first valve stem along a longitudinal axis of the tubular member; and a second solenoid assembly arranged on a second side of the valve assembly and including an adjustable second valve train engageable with the gate and a second push solenoid operatively coupled to the adjustable second valve train to move the gate in a second direction opposite the first direction, wherein the adjustable second valve train includes a second valve stem operatively coupled to a second push rod with a second coupling, wherein the second valve stem is arranged laterally to the second push rod with a second distance between the second push rod and the second valve stem along the longitudinal axis, wherein moving the gate in the first direction with the first solenoid assembly increases flow through the gate and alternately moving the gate in the second direction with the second solenoid assembly decreases flow through the gate, wherein alignment between the gate and the valve seat is adjustable based on a stroke length adjustment for the adjustable first valve train and the adjustable second valve train by adjusting the first coupling to adjust the first distance between the first push rod and the first valve stem and adjusting the second coupling to adjust the second distance between the second push rod and the second valve stem.

2. The telemetry module of claim 1, wherein the first and second solenoid assemblies are aligned with the longitudinal axis of the tubular member.

3. The telemetry module of claim 1, wherein the first and second solenoid assemblies are misaligned with the longitudinal axis of the tubular member.

4. The telemetry module of claim 1, wherein the first push rod is engageable with a first side surface of the gate, and wherein the second push rod is engageable with a second side surface of the gate.

5. The telemetry module of claim 4, wherein, when the first push solenoid is operated to move the first push rod in the first direction, the second push solenoid is inactive and the second valve stem and the second push rod are able to move in the first direction, and wherein, when the second push solenoid is operated to move the second push rod in the second direction, the first push solenoid is inactive and the first valve stem and the first push rod are able to move in the second direction.

6. The telemetry module of claim 1, wherein the first and second couplings are each adjustable to adjust a stroke length for the first and second push rods, respectively.

7. The telemetry module of claim 1, wherein the first coupling is interposed between the first push rod and the first valve stem, and wherein the second coupling is interposed between the second push rod and the second valve stem.

8. The telemetry module of claim 1, wherein the gate floats between the adjustable first and second valve trains.

9. The telemetry module of claim 1, wherein the gate is operatively coupled to one or both of the adjustable first and second valve trains.

10. A well system, comprising:

a tubular member extendable within a wellbore, the tubular member defining an annulus port that provides fluid communication between an interior of the tubular member and an annulus defined between the tubular member and the wellbore;

a telemetry module positioned within the tubular member and including:

a valve assembly that provides a gate defining one or more gate valve flow ports and a valve seat defining one or more valve seat flow ports;

a first solenoid assembly arranged on a first side of the valve assembly and including a first push solenoid that operates to move the gate in a first direction, the first solenoid assembly coupled to the gate via an adjustable first valve train, wherein the adjustable first valve train includes a first valve stem operatively coupled to a first push rod with a first coupling, wherein the first valve stem is arranged laterally to the first push rod with a first distance between the first push rod and the first valve stem along a longitudinal axis of the tubular member; and a second solenoid assembly arranged on a second side of the valve assembly and including a second push solenoid that operates to move the gate in a second direction opposite the first direction, the second solenoid assembly coupled to the gate via an adjustable second valve train, wherein the adjustable second valve train includes a second valve stem operatively coupled to a second push rod with a second coupling, wherein the second valve stem is arranged laterally to the second push rod with a second distance between the second push rod and the second valve stem along the longitudinal axis, wherein moving the gate in the first direction with the first solenoid assembly increases flow through the gate and alternately moving the gate in the second direction with the second solenoid assembly decreases flow through the gate, wherein alignment between the gate and the valve seat is adjustable based on a stroke length adjustment for the adjustable first valve train and the adjustable second valve train by adjusting the first coupling to adjust the first distance between the first push rod and the first valve stem and adjusting the second coupling to adjust the second distance between the second push rod and the second valve stem.

11. The well system of claim 10, wherein the tubular member is selected from the group consisting of drill pipe, a drill collar, casing, production tubing, and any combination thereof.

12. The well system of claim 10, wherein the valve assembly further comprises:

a screen in fluid communication with the interior of the tubular member;

an inlet port in fluid communication with the interior via the screen; and an outlet port in fluid communication with the annulus port, wherein flow through the gate allows a fluid in the interior to traverse the valve assembly and be introduced into the annulus.

13. The well system of claim 10, wherein the first valve stem is engageable with a first side surface of the gate, and the second valve stem is engageable with a second side surface of the gate, the second side surface being opposite the first side surface.

14. The well system of claim 10, wherein the first and second couplings are each adjustable to adjust a stroke length for the first and second push rods, respectively.

15. The well system of claim 13, wherein the gate floats between the first and second valve stems.

16. The well system of claim 13, wherein, when the first push solenoid is operated to move the first push rod in the first direction, the second push solenoid is inactive and the second valve stem and the second push rod are able to move in the first direction, and wherein, when the second push solenoid is operated to move the second push rod in the second direction, the first push solenoid is inactive and the first valve stem and the first push rod are able to move in the second direction.

17. A method, comprising:

introducing a telemetry module into a wellbore, the telemetry module being positioned within an interior of a tubular member and providing a valve assembly that includes a gate movable with respect to a valve seat, the telemetry module further including a first solenoid assembly arranged on a first side of the valve assembly and having a first push solenoid, and a second solenoid assembly arranged on a second side of the valve assembly and having a second push solenoid, wherein the first side is opposite the second side, wherein the first solenoid assembly is coupled to the gate via an adjustable first valve train and the second solenoid assembly is coupled to the gate via an adjustable second valve train, wherein the adjustable first valve train includes a first valve stem operatively coupled to a first push rod with a first coupling and the adjustable second valve train includes a second valve stem operatively coupled to a second push rod with a second coupling, wherein the first valve stem is arranged laterally to the first push rod with a first distance between the first push rod and the first valve stem along a longitudinal axis of the tubular member, wherein the second valve stem is arranged laterally to the second push rod with a second distance between the second push rod and the second valve stem along the longitudinal axis;

circulating a fluid through the interior of the tubular member, the tubular member defining an annulus port that provides fluid communication between an annulus defined between the tubular member and the wellbore and the interior via the valve assembly;

activating the first push solenoid to move the gate in a first direction and increase flow through the gate, thereby injecting a portion of the fluid into the annulus via the valve assembly and thereby generating a pressure pulse within the annulus;

activating the second push solenoid to move the gate in a second direction opposite the first direction to decrease flow through the gate; and alternatingly activating the first and second push solenoids to selectively move the gate in the first and second directions and thereby injecting portions of the fluid into the annulus that generate a plurality of pressure pulses within the annulus, wherein alignment between the gate and the valve seat is adjustable based on a stroke length adjustment for the adjustable first valve train and the adjustable second valve train by adjusting the first coupling to adjust the first distance between the first push rod and the first valve stem and adjusting the second coupling to adjust the second distance between the second push rod and the second valve stem.

18. The method of claim 17, wherein the telemetry module is communicably coupled to one or more sensors, the method further comprising communicating measurements obtained by the one or more sensors by generating the plurality of pressure pulses within the annulus.

19. The method of claim 17, wherein the valve assembly further comprises, a screen in fluid communication with the interior of the tubular member, an inlet port in fluid communication with the interior via the screen, and an outlet port in fluid communication with the annulus port, and wherein injecting the portion of the fluid into the annulus via the valve assembly comprises:

flowing the portion of the fluid into the inlet port via the screen;

flowing the portion of the fluid from the inlet port and into the outlet port via one or more gate valve flow ports defined in the gate aligned with one or more valve seat flow ports defined in the valve seat; and flowing the portion of the fluid from the outlet port into the annulus via the annulus port.

20. The method of claim 17, wherein the first push solenoid is operatively coupled to the first push rod, which is engageable with a first side surface of the gate, and wherein activating the first push solenoid and thereby moving the gate in the first direction comprises pushing the first push rod and the first valve stem with the first push solenoid to engage the first side surface of the gate.

21. The method of claim 20, wherein the second push solenoid is operatively coupled to the second push rod, which is engageable with a second side surface of the gate, the second side surface being opposite the first side surface, and wherein activating the second push solenoid to move the gate in the second direction comprises pushing the second push rod and the second valve stem with the second push solenoid to engage the second side surface of the gate.

22. The method of claim 17, further comprising:

deactivating the second push solenoid when the first push solenoid is activated; and deactivating the first push solenoid when the second push solenoid is activated.

23. The method of claim 21, wherein the first and second couplings are each adjustable to adjust a stroke length for the first and second push rods, respectively.

* * * * *